US005094582A

United States Patent [19]

Molzhon

[11] Patent Number: 5,094,582

[45] Date of Patent: Mar. 10, 1992

[54] WASTE COLLECTION AND DISPOSAL SYSTEM

[76] Inventor: Fred Molzhon, 744 Sunnywood Rd., Newport News, Va. 23601

[21] Appl. No.: 560,058

[22] Filed: Jul. 27, 1990

[51] Int. Cl.[5] ..... B65F 3/04

[52] U.S. Cl. ..... 414/406; 414/408; 414/411; 414/414; 414/786; 220/909

[58] Field of Search ..... 414/405, 404, 406, 407, 414/408, 411, 303, 546, 548, 786, 414; 220/909

[56] References Cited

U.S. PATENT DOCUMENTS

| | | | |
|---|---|---|---|
| 2,951,602 | 9/1960 | Walden et al. | 414/411 |
| 3,011,666 | 12/1961 | Dempster et al. | 414/411 X |
| 3,211,312 | 10/1965 | Miller | 414/406 |
| 3,315,828 | 4/1967 | Dubo | 414/406 X |
| 4,113,125 | 9/1978 | Schiller | 414/525.4 X |
| 4,960,220 | 11/1990 | Foa | 414/406 X |
| 5,012,142 | 5/1991 | Carson | 414/408 |

FOREIGN PATENT DOCUMENTS

| | | | |
|---|---|---|---|
| 0257442 | 3/1988 | European Pat. Off. | 414/408 |
| 3703557 | 8/1988 | Fed. Rep. of Germany | 414/408 |

*Primary Examiner*—Frank E. Werner
*Assistant Examiner*—James Keenan
*Attorney, Agent, or Firm*—James Nemmers

[57] ABSTRACT

A waste collection and disposal system utilizing a multi-compartment container and a collection vehicle with compartments corresponding to those of the container so as to keep the different waste materials separated throughout the collection process. The container has a locked cover over each compartment that is automatically unlocked when the container is placed in the inlet chute of the collector vehicle and descends to the bottom of the chute. To assure alignment of the compartments of the container with the proper compartments in the collector vehicle, the locking mechanisms holding the lids over the compartments of the container are arranged in an asymmetrical pattern that corresponds to the relative location of grooves in a tapered inlet chute leading to the compartments in the collector vehicle.

9 Claims, 2 Drawing Sheets

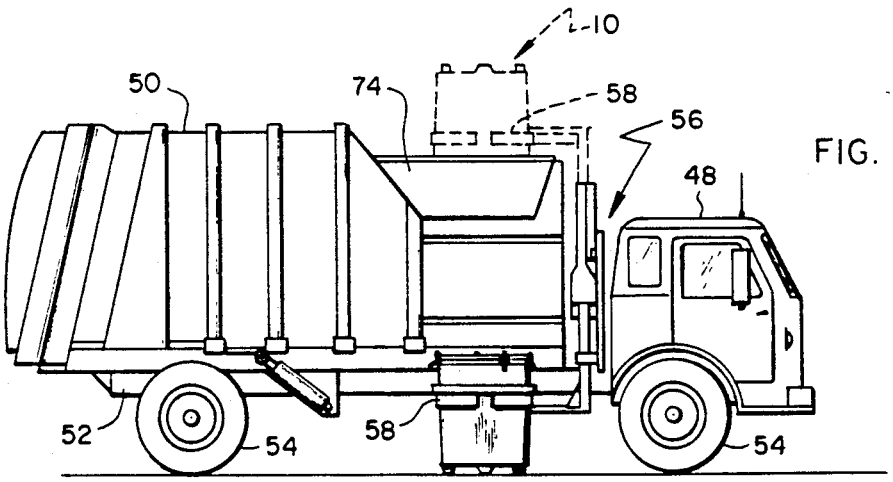
FIG. 1
FIG. 2
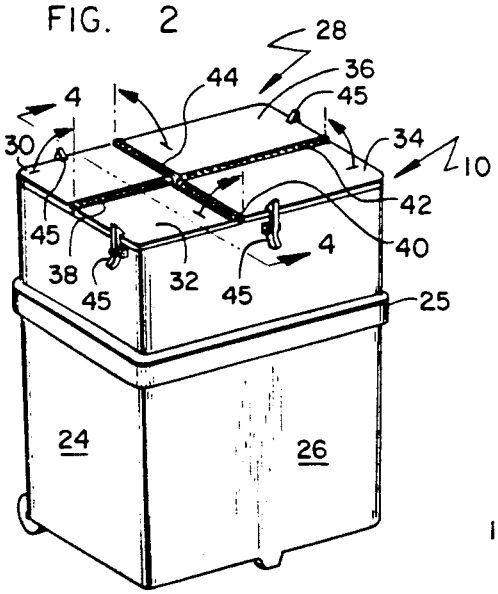
FIG. 3
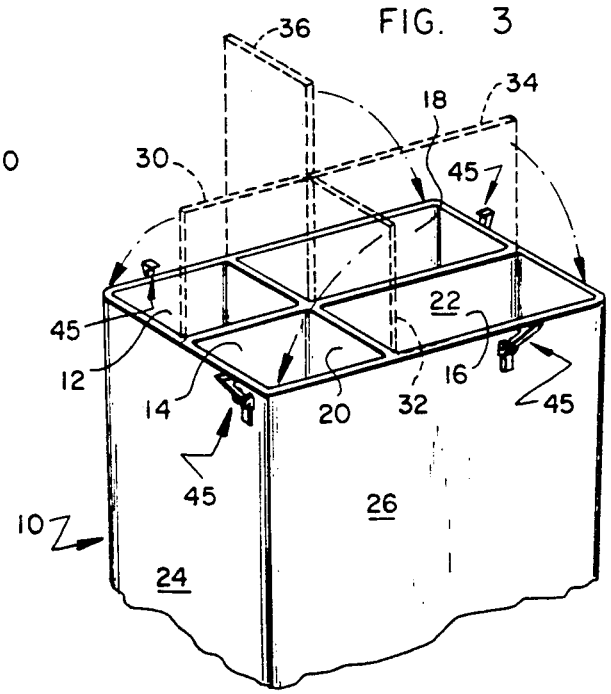
FIG. 4
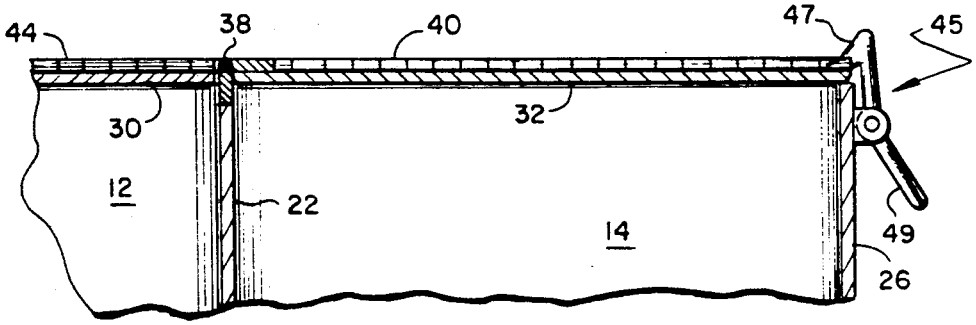

WASTE COLLECTION AND DISPOSAL SYSTEM

BACKGROUND OF THE INVENTION

There is a rapidly increasing concern with contamination of the environment caused by improper waste disposal. The general solution that has been proposed is to separate the waste products from businesses and residences into classifications so that recyclable materials can be separated from potentially toxic materials and waste materials that are otherwise safe for disposal.

In some parts of the country, systems have been established in which a householder separates trash into color-coded containers, which are then picked up and dumped into a truck that has separate compartments color-coded to correspond to the householder's trash containers. This, of course, requires the householder to have several separate containers for the different types of waste. This also makes it difficult for the trash collector to efficiently load the waste into the collector vehicle since the trash is separated by visual codes only.

There is therefore a need for a waste collection and disposal system which will minimize the number of containers that a household must maintain, and which will also improve the collection efficiency of the various types of waste. In order for the system to be effective, any such system must be easy and relatively inexpensive for the householder to use, and also must facilitate the proper collection of the waste while maintaining the waste into the predetermined classifications throughout the collection and disposal process.

SUMMARY OF THE INVENTION

The waste disposal and collection system of the invention utilizes a multi-compartment container having multiple, lockable lids covering each of the compartments. The most practical configuration for such a container from the standpoint of both manufacture and use is a rectangular container. The preferred embodiment of the invention discloses a container with four compartments, but the principles of the invention are applicable to containers of any number of compartments. In the preferred embodiment, a container of four compartments may use, for example, two compartments for paper and garbage and two for other types of waste. In this manner, the container and system of the invention may be adapted to satisfy even the most discriminating plans for waste collection and disposal. Partitions inside the container divide the container into compartments each with a lid hinged on an axis located in the same plane as one of the container partitions. Each lid also has its own lock located on the outside of the container and is actuated by pressure exerted toward the container. A collector vehicle of a known design has a lift mechanism to grab, lift and invert individual containers. The vehicle also has a collector body that is divided into compartments compatible with the container design and having a tapered inlet chute with a configuration corresponding to the exterior configuration of the container. In this manner, when the container is lifted and inverted to dump its contents, the container will automatically be guided so the proper compartments of the container will be properly aligned with the corresponding compartments of the collector vehicle. An automatic lock on the container cover maintains the lids to the compartments closed until the container is inverted and positioned in the collector chute. The final lowering movement of the container will release the locks to permit the lids to swing open allowing discharge of the container contents.

BRIEF DESCRIPTION OF THE DRAWINGS

FIG. 1 is a side elevational view of a collector vehicle;

FIG. 2 is a perspective view of a container constructed according to the principles of the invention;

FIG. 3 is a perspective view of a container constructed according to the principles of the invention, but with the container cover shown in dotted lines in the open position;

FIG. 4 is a sectional view of a portion of the container and cover taken on the line 4—4 of FIG. 2;

DESCRIPTION OF THE PREFERRED EMBODIMENT OF THE INVENTION

Figure 5:
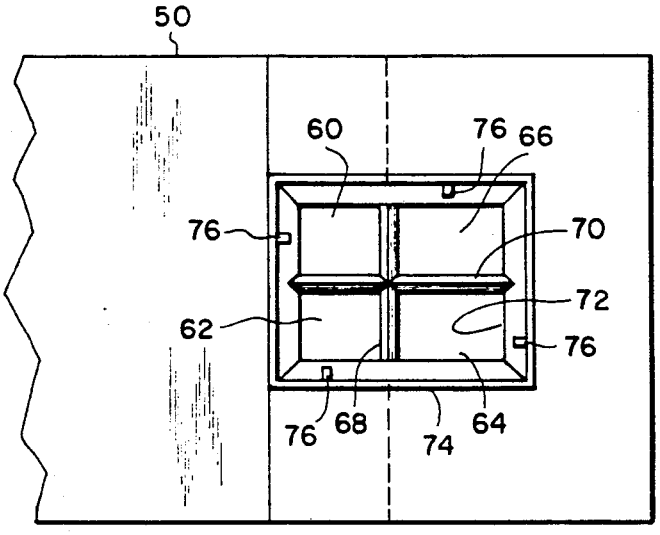
FIG. 5 is a top plan view of the inlet chute of the collector vehicle body.

In the drawings there is illustrated a container 10 having four separate compartments 12, 14, 16 and 18 which are formed by two interior partitions 20 and 22. The container illustrated is of a general rectangular shape with shorter sides 24 and longer sides 26. The container 10 has a band 25 extending around sides 24 and 26 about midway up the sides for a purpose which will be evident from the description hereinafter.

The four compartment container appears at this time to be the most practical from the standpoint of fabrication of the container and its use in the waste collection process. However, the principles of the invention are applicable to containers having multiple compartments of the desired number to meet the needs of the particular waste collection program in which the invention is used. For example, in a four compartment container, two of the compartments may be assigned to receive paper and general garbage. The other two compartments may be assigned to collectibles either to be recycled or for special disposition. Recyclable materials are envisioned as aluminum, plastic, glass, etc. on a rotating schedule until all items desired from the program have been satisfied. Of course, the capacities of the individual compartments as well as the size of the container will depend upon the particular use and desires of the program planned for use of the container. However, using the principles of the invention as described herein, the one basic container design will generally serve the needs of most situations, although different sizes of the basic configuration may be required.

The container 10 also has a cover, indicated generally by the reference numeral 28, which completely covers all four of the compartments 12, 14, 16 and 18. As best seen in FIGS. 2 and 3, the cover 28 is divided into four separate and independent lids 30, 32, 34 and 36 which cover respectively compartments 12, 14, 16 and 18. Each of the lids 30, 32, 34 and 36 are independently and separately hinged on hinges 38, 40, 42 and 44. Preferably, these hinges are of the piano type, and hinges 38 and 42 are located immediately above and in the same plane as interior partition 22, while hinges 40 and 44 are located in the plane of the interior partition 20. This assures the complete emptying of each of the compartments of container 10 when the container 10 is inverted with the lids open while maintaining the separateness of the various waste materials throughout the collection and disposal process.

Lids 30, 32, 34 and 36 are normally closed and each is locked with a releasable lock 45 of any suitable type that will maintain the waste in the compartments. Locks 45 can be automatically unlocked to open the lids when the container 10 is properly positioned in the inlet chute of the collector vehicle in the manner described hereinafter. To accomplish this, each lock 45 is pivotally mounted on a side 24 or 26 and has a nose 47 that engages the top of a lid to force it down against the top edges of the sidewalls. Nose 47 is biased downwardly by a spring 51 (FIG. 6), and a handle 49 extends outwardly on the other side of the pivot so that when the handle 49 is forced inwardly against the spring 51, the nose 47 will move away from the lid and allow the lid to open. As best seen in FIG. 2, the locks 45 are positioned off center of the outer edge of each lid to assure proper alignment of the container 10 when inverted for discharge in the inlet chute of the collector vehicle. This is more fully explained hereinafter.

Referring now to FIGS. 1 and 5, there is shown a collector vehicle having a cab 48 and a body 50 mounted on a suitable chassis 52 that in turn is mounted on ground engaging wheels 54. A standard "in use" type vehicle is shown for the purpose of illustrating the basic workings of a collector vehicle, although the basic design is not a part of the invention. However, use of the collector vehicle to carry out the principles of the invention will require the point of deposit for the material being transferred to the collector vehicle to be at a point towards the center of the collector box to facilitate the additional compartments needed. Secured to the chassis 52 and operable by the driver-operator located in cab 48 is a lift mechanism indicated generally by the reference numeral 56. The lift mechanism is of any suitable design, well known to those skilled in the art and which are commonly used on commercially available collector vehicles. The lift mechanism 56 includes grabbers 58 that are moveable inwardly and outwardly to grasp the container 10 and release it under control of the operator from controls (not shown) located in the cab 48.

Figure 6:
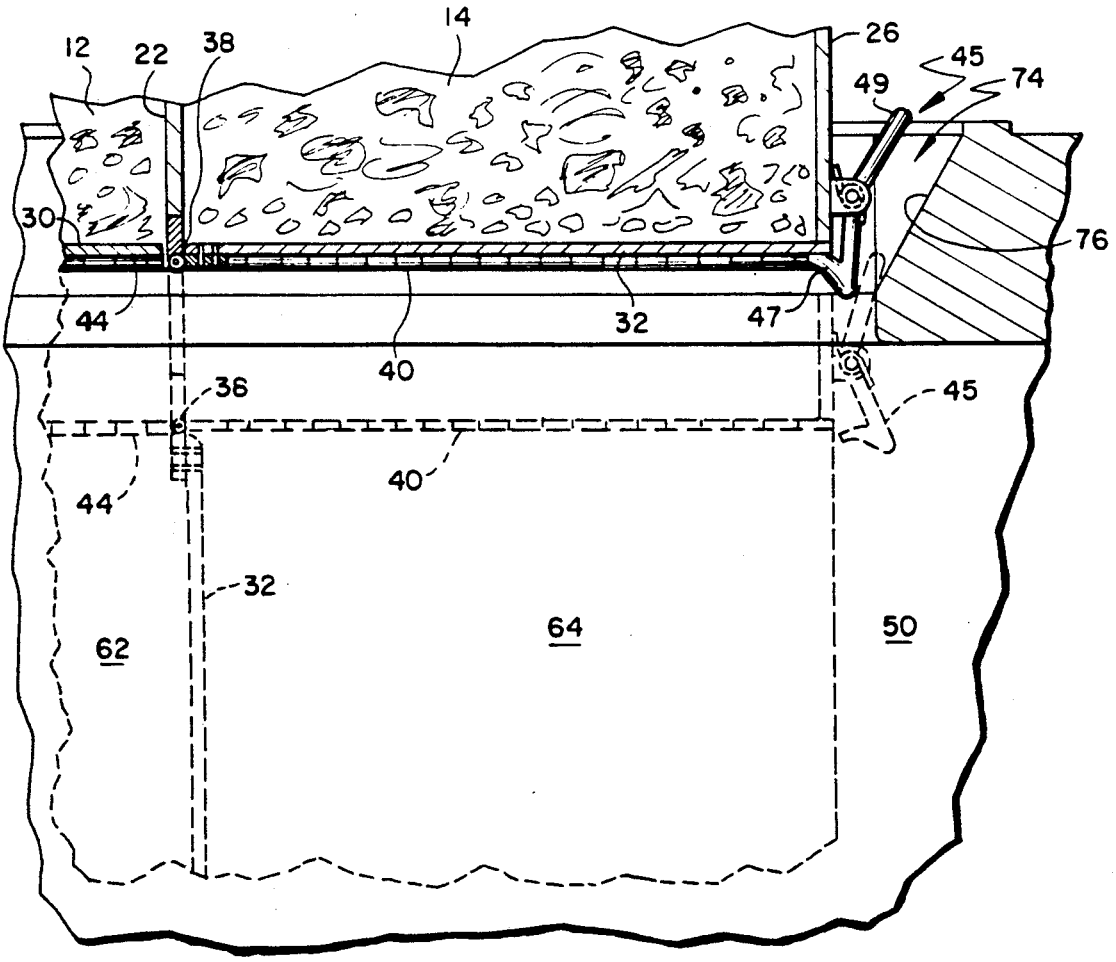
FIG. 6 is a side elevational view, mostly in section, and showing a container in position in the inlet chute of the collector vehicle.

The body 50 of the collector vehicle is divided into compartments 60, 62, 64 and 66 (FIG. 5) corresponding in number to those of the container 10. These compartments are defined by partitions 68 and 70 and are joined at a common point located generally centrally in an opening 72 at the bottom of the inlet chute 74. Inlet chute 74 has four downwardly and inwardly sloping sides of the same relative dimensions as the sides of the container 10, and in each side is a vertical groove 76 the relative position of which corresponds to the position of the locks 45 on the container 10. The opening 72 is also of the approximate size of the top of the container 10. Because of the rectangular configuration of the container 10 and the asymmetrical placement of the locks 45, as the container is inverted and placed into the inlet chute 74, it cannot descend completely to the bottom of the chute 74 unless properly positioned with the sides of the container 10 aligned with the corresponding sides of the inlet chute 74 and the locks 45 aligned with corresponding grooves 76 in the walls on the chute 74.. If the container 10 is thus properly aligned, gravity will allow the container to descend to the bottom of the inlet chute 74 directly above the opening 72. At the bottom of the chute 74, the handles 49 of the locks 45 will be forced inwardly by engagement with the bottom edges of the opening 72, thereby unlocking the lids 30, 32, 34 and 36 of the container 10 and permitting the contents of the container compartments to be discharged into the corresponding compartments of the collector vehicle. Release of the locks 45 in this manner is illustrated in FIG. 6. When the contents of the container 10 are empty, the lift mechanism 56 will return the container 10 to an upright position allowing gravity to close the lids back onto the container. The operator will then release the grabbers 58 and move to the next container. The user can relock the lids in place at the proper time when waste is again deposited into one of the compartments of the container.

From the foregoing description it will be evident that the collector vehicle is provided with compartments corresponding in number to those in the container, and because of the asymmetrical placement of the locks 4 and the rectangular shape of the container combined with the corresponding shape of the walls of the inlet chute of the collector vehicle, proper alignment of the container will be assured. The waste in the compartments of container 10 will be retained by the locked lids until the locks 45 are release at the bottom of the inlet chute 74, which can occur only if the container 10 is properly aligned in the inlet chute 74 with the locks 45 aligned with and engaged in the grooves 76.. Thus, the container and collector vehicle design allow simple, efficient and near foolproof collection and separation of waste materials. Obviously, various revisions and modifications can be made to the preferred embodiment described herein without departing from the spirit and scope of the invention. For example, the top surface of the cover 28 may be sloped from the center to the outside in a somewhat dome shape for weather protection. The collector vehicle may contain a known and commercially available means to compact items such as paper and garbage to increase the volume of compressible materials that may be handled. Of course, each compartment of the collection vehicle would have a separate and independent means for discharging the contents in order to maintain the collected materials separate throughout the complete cycle. Collection vehicles presently in use in refuse collection systems commonly have a rearward moving compactor in the collector compartment which serves to increase the quantity of materials handled. A rear opening door is also provided to permit the compactor mechanism to forcefully remove the contents of the compartment at the discharge or dumping point. This same configuration may be used in conjunction with the invention if altered to independently compact and discharge the contents of the two rearmost compartments. The two forward compartments (used for glass, aluminum, etc.) may have a side opening provision and, if needed, a bottom or floor surface that slopes toward the discharge point should gravity be used as the means for discharge of the material collected. With controls that permit independent operation of the release mechanisms, it would be possible to move the collection vehicle to designated areas prior to dumping to maintain the segregation function throughout the complete operation. There are many other revisions and modifications which can be made to the preferred embodiment described herein without departing from the spirit and scope of the invention. It is my intention however that all such revisions and modifications as are obvious to those skilled in the art will be included within the scope of the following claims.

What is claimed is as follows:

1. A portable waste collection container for use with a collection vehicle, said vehicle having a plurality of separate adjacent compartments open at the top to receive different types of waste and having a common inlet chute above the compartments, said container comprising a bottom walls, side walls extending upwardly from the bottom wall to a top edge to form an enclosure with an open tope, a partition extending between the side walls to divide the enclosure into a plurality of waste compartments corresponding in number to the compartments in the collection vehicle, a separate cover for each of the container compartments, each cover being mounted for pivotal movement from an open to a closed position and being normally in a closed position, the container having mounted thereon a releasable lock combined with each cover for independently maintaining each cover normally in a closed position, each lock including a release means which causes the simultaneous release of each of the locks when the release means engage the inlet chute in the collection vehicle just above the open tops of the compartments of the collection vehicle, thereby allowing the covers to simultaneously move to an open position for discharge of waste into the container compartments.

2. The portable waste collection container of claim 1 in which means is provided to align the container compartments with the collection vehicle compartments before the release means releases the container cover locks.

3. The portable waste collection container of claim 2 in which the inlet chute of the collector vehicle is provided with grooves extending toward the open tops of the collector vehicle compartments, there being one such groove for each lock, and the release means for the locks each have a lock release portion extending outwardly from the container for engagement with one of the grooves, the locks being positioned on the container in a manner such that the container must be properly positioned before the lock release portions will engage the grooves.

4. The portable waste collection container of claim 3 in which each lock has a locking nose engageable over a cover to hold the cover in a closed position, means is provided to bias the locking nose onto the cover, and each lock release means has a releasing member extending outwardly from the container, the locking nose and releasing member being on opposite sides of a pivot for the lock so that when the releasing member is moved inwardly the locking nose will release the cover.

5. The portable waste collection container of claim 4 in which the releasing member of each lock is engageable in one of the grooves when the container is properly aligned, the releasing member being forced inwardly as the container reaches the bottom of the inlet chute of the collector vehicle.

6. A portable waste collection container for use with a collection vehicle, said vehicle having a plurality of separate adjacent compartments open at the top to receive different types of waste and having a common inlet chute above the compartments, said inlet chute having grooves extending toward the open tops of the compartments, said container comprising a bottom wall. side walls extending upwardly from the bottom wall to a top edge to form an enclosure with an open top, a partition extending between the side walls to divide the enclosure into a plurality of waste compartments corresponding in number to the compartments in the collection vehicle, a separate cover for each of the container compartments, each cover being mounted for pivotal movement from an open to a closed position and being normally in a closed position, a releasable lock for maintaining each cover in a closed position, said locks each having a lock release portion extending outwardly from the container for engagement with one of the grooves in the inlet chute thereby allowing the covers to move to an open position for discharge of waste in the container compartments, the locks being positioned on the container in a manner such that the container must be properly positioned before the lock release portions of the locks will engage the grooves, and means to align the container compartments with the collection vehicle compartments before the lock release portions release the container cover locks.

7. The portable waste collection container of claim 6 in which each lock has a locking nose engageable over a cover to hold the cover in a closed position, means is provided to bias the locking nose onto the cover, and each lock has a releasing member extending outwardly from the container, the locking nose and releasing member being on opposite sides of a pivot for the lock so that when the releasing member is moved inwardly the locking nose will release the cover.

8. The portable waste collection container of claim 7 in which the releasing member of each lock is engageable in one of the grooves when the container is properly aligned, the releasing member being forced inwardly as the container reaches the bottom of the inlet chute of the collector vehicle.

9. A method of collecting and disposing of waste materials of different types and maintaining the different waste materials separate throughout the collection and disposal process, said method comprising: providing a collection container having a plurality of separate compartments, each for a different type of waste material; providing a separate cover for each of the compartments of the collection container; providing a separate lock combined with each cover for maintaining the cover normally in a closed position during the collection process and while the container is inverted during the collection process, each lock being released by force applied to the lock in a direction toward the container; providing a collection vehicle having waste compartments corresponding in number and relative position to the compartments in the collection container; and providing the collection vehicle with a chute above the compartments, the chute having tapered walls that apply force to the locks as the collection container reaches the bottom of the chute in an inverted position thereby simultaneously releasing each of the locks on the collection container covers to simultaneously discharge the contents of each of the containers into the compartments of the collection vehicle.

* * * * *